United States Patent [19]

Rojo, Jr.

[11] 4,178,343

[45] Dec. 11, 1979

[54] MANUFACTURE OF PRECAST CONCRETE UNITS AND A BUILDING CONSTRUCTED THEREWITH

[76] Inventor: Agustin Rojo, Jr., Paseo del Parque Z-12, Garden Hills, Bayamon, P.R. 00657

[21] Appl. No.: 874,057

[22] Filed: Feb. 1, 1978

Related U.S. Application Data

[62] Division of Ser. No. 797,292, May 16, 1977, Pat. No. 4,127,971.

[51] Int. Cl.[2] ..... B28B 7/22; E04G 11/36

[52] U.S. Cl. ..... 264/333; 249/27

[58] Field of Search ..... 249/27, 11, 22, 39, 249/162, 178, 181, 185, 34, 37, 47, 120, 137, 158, 172, 13, 19; 425/62; 264/219, 333, 334

[56] References Cited

U.S. PATENT DOCUMENTS

| | | | |
|---|---|---|---|
| 2,356,603 | 8/1944 | Marchbanks | 249/22 X |
| 3,340,926 | 9/1967 | Sylvester | 249/158 X |
| 3,693,930 | 9/1972 | Wakefield | 249/158 X |
| 3,696,177 | 10/1972 | Holland | 249/27 X |
| 3,822,855 | 7/1974 | Hummelshoj | 249/120 X |
| 3,843,089 | 10/1974 | Scholz | 249/158 |
| 3,847,521 | 11/1974 | Stickler | 249/27 X |
| 3,853,452 | 12/1974 | Delmonte | 249/27 X |
| 3,881,856 | 5/1975 | Fougea | 249/158 X |
| 3,892,516 | 7/1975 | McGrew | 249/120 X |

*Primary Examiner*—Roy Lake
*Assistant Examiner*—John S. Brown
*Attorney, Agent, or Firm*—Erwin M. Barnett

[57] ABSTRACT

A tripling or more in the production rate of precast concrete building units utilizing reusable mold forms is achieved by casting the units vertically on a wheeled base between separable vertical mold forms. The partially cured poured concrete unit is horizontally transported on the wheeled base from between the separated molds to complete the curing independently thereof, the forms being immediately serviceable with another wheeled base for molding another unit.

A building is erected on a concrete slab foundation using a plurality of precast concrete units in the form of L-shaped walls positioned as corner structure and spaced intermediate exterior wall elements and as interior partitions and roof supports. The L-shaped walls are bolted to the foundation by anchoring means located in cutout portions along the bottom of each wall and H-beams are placed to extend across the tops of the walls and are filled with concrete to serve as support and anchoring means for precast concrete roof slabs and to bridge the spaces between the concrete walls as lintels for doors and windows which complete the exterior wall enclosure of the building.

5 Claims, 10 Drawing Figures

MANUFACTURE OF PRECAST CONCRETE UNITS AND A BUILDING CONSTRUCTED THEREWITH

This is a division of patent application Ser. No. 797,292, filed May 16, 1977, and now U.S. Pat. No. 4,127,971.

BACKGROUND OF THE INVENTION

1. Field of the Invention

This invention relates generally to concrete building structures and more particularly is directed to an improved method and apparatus for precasting concrete building elements in vertical molds and to a building construction utilizing as the principal structural elements a plurality of similar concrete L-shaped wall units and flat roof slabs precast thereby.

2. Description of the Prior Art

In order to reduce labor cost and save time in erecting and dismantling the forms required in poured concrete wall and roof construction, various means and methods have been devised to precast concrete wall units usually at remote manufacturing facilities requiring expensive equipment as well as costs for transporting and handling the precast units in delivery to the building site. Although precasting has been performed in molds disposed both horizontally and vertically, both methods require in excess of twelve hours for the concrete to be sufficiently cured to permit vertical lifting out of the mold for the latter's reuse. Steam curing and/or use of additives to the concrete mix reduces this time to between six to eight hours, but is a much more costly procedure.

Likewise, to reduce building costs and improve efficiency, particularly in erecting bungalow type single family dwellings, various units, precast and prefabricated as entire room units, entire wall units, made in a wide variety of sizes and configurations, as segmental units and as individual panels, have been proposed and used. Each of these units has its own disadvantages and drawbacks, including requirements for costly manufacturing plant facilities, special on site erecting equipment and transportation means from point of manufacture. There is, therefore, a need, particularly in low cost housing, which this invention satisfies, for a durable concrete building capable of being erected by taking advantage of the economy of precast units while eliminating costly plant and transportation facilities and also having an inexpensive system for assembling the precast units into a completed structure.

SUMMARY OF THE INVENTION

Among the objects of the invention is to provide a method and apparatus for precasting poured concrete building units on an accelerated time schedule producing at least three units per mold per day yet eliminating costly steam curing and concrete mix additives. The precasting apparatus shall utilize readily constructable plywood faced, vertically disposed mold forms mounted for easy handling, separation and reuse. The method, utilizing such separable mold forms shall be capable of being performed at the building site having conventional concrete mixing and pouring facilities.

The apparatus and method embodying the invention is particularly adapted to precasting freestanding L-shaped wall units and pairs of relatively flat roof slabs. The apparatus essentially comprises a mold having three separable parts, namely, a mold bottom and two opposite vertical sidewalls, each mounted on wheels for transport on a horizontal surface. The wheeled mold bottom is sized and shaped to support a molded unit freestanding in vertical position as cast and the opposite side walls are adapted to separate from a closed position in operative engagement with the mold bottom to an open position spaced a sufficient distance from each other to enable the mold bottom carrying a partially cured concrete molded unit to be wheeled horizontally on the surface to a position completely free of the vertical sidewalls to complete the curing of the unit and to be replaced by another wheeled mold bottom for reuse of the mold.

The method, embodying the invention, maximizes utilization of relatively inexpensive molding equipment whereby unit production is increased on the order of three times while maintaining labor costs at a minimum. The method comprises pouring mixed concrete of any conventional formulation, that is, without special additives for accelerating the curing time, into the mold cavity which has been assembled from the hereinbefore described three separable and wheel mounted parts. The concrete is maintained in the mold for a period of 2½ to 3 hours at which time the molded unit will have sufficiently cured, that is, set, to be capable of freestanding without the aid of the mold sidewalls. The mold is then disassembled by wheeling the opposite vertical walls apart to release the bottom support bearing the partially cured concrete unit for rolling horizontally on its wheels to a position clear of the sidewalls where the unit completes its curing to a condition for handling by vertical lifting. During this final curing time interval, which may be upwards of 10 hours, other wheeled bottoms are sequentially assembled with the vertical sidewalls into immediately usable molds and the cycle repeated.

The precast L-shaped units serve as the sole vertical support means for a building and are arranged on a poured concrete foundation in a predetermined relation. One L-shaped unit is located at each of the corners of the building providing adjacent exterior wall portions. Spaced between the corners, one section of one or more L-shaped units provides an intermediate exterior wall portion, while the other right angularly disposed section, when extending inwardly, forms part of an interior wall or partition, or when projecting outwardly may serve as a wind breaker, decorative wall or part of an outside utility shed.

The freestanding characteristics of the L-shaped units contribute to the simplicity of their attachment to the foundation requiring a single anchoring means for each section of the unit. Such anchoring means, located in a cutout formed in the bottom of each section, comprises a pair of threaded tie rods, one embedded in the section wall, the other in the foundation, projecting into the cutout in substantially axial alignment so that the free ends thereof are spaced from each other. The free ends of the tie rods are interconnected by projecting through aligned openings formed in opposite parallel arms of a U-shaped bracket and have nuts threaded thereon and tightened against the interior surface of the bracket.

A metal H-beam extends the length of each exterior wall as an upper coplanar border thereof and seats on the top edges of the exterior wall sections of the L-shaped units, which top edges extend into the downfacing trough of the H-beam. The upfacing trough of the H-beam provides a permanent form for reinforced poured concrete combining therewith as a strengthened reinforced composite structure which carries the roof and serves as lintels across the spaces between the wall sections. The poured concrete in the H-beam also receives tie rods extending up from the wall sections and has other tie rods embedded therein to extend upwardly between the roof slabs as anchoring means therefor.

The reinforced concrete roof slabs are of a length to extend between and overlap a pair of opposite exterior walls of the building and have upfacing sides with thickened peripheral edge borders. The slabs are placed side by side longitudinally with flat downfacing sides resting on the concrete filled H-beams. A metal channel has a cross-section which conforms to the width of two adjacent upper flat surfaces and the two downwardly extending interior sides of the thickened edge borders and rests thereon as part of a tie-down joint. The tie rods, which are embedded in the concrete of the H-beams and extend upwardly between the adjacent thickened edge borders, have threaded ends extending through aligned openings in the metal channel and are engaged by nuts which complete the tie-down joint anchoring means for the roof slabs.

DESCRIPTION OF THE PREFERRED EMBODIMENTS

Figure 2:
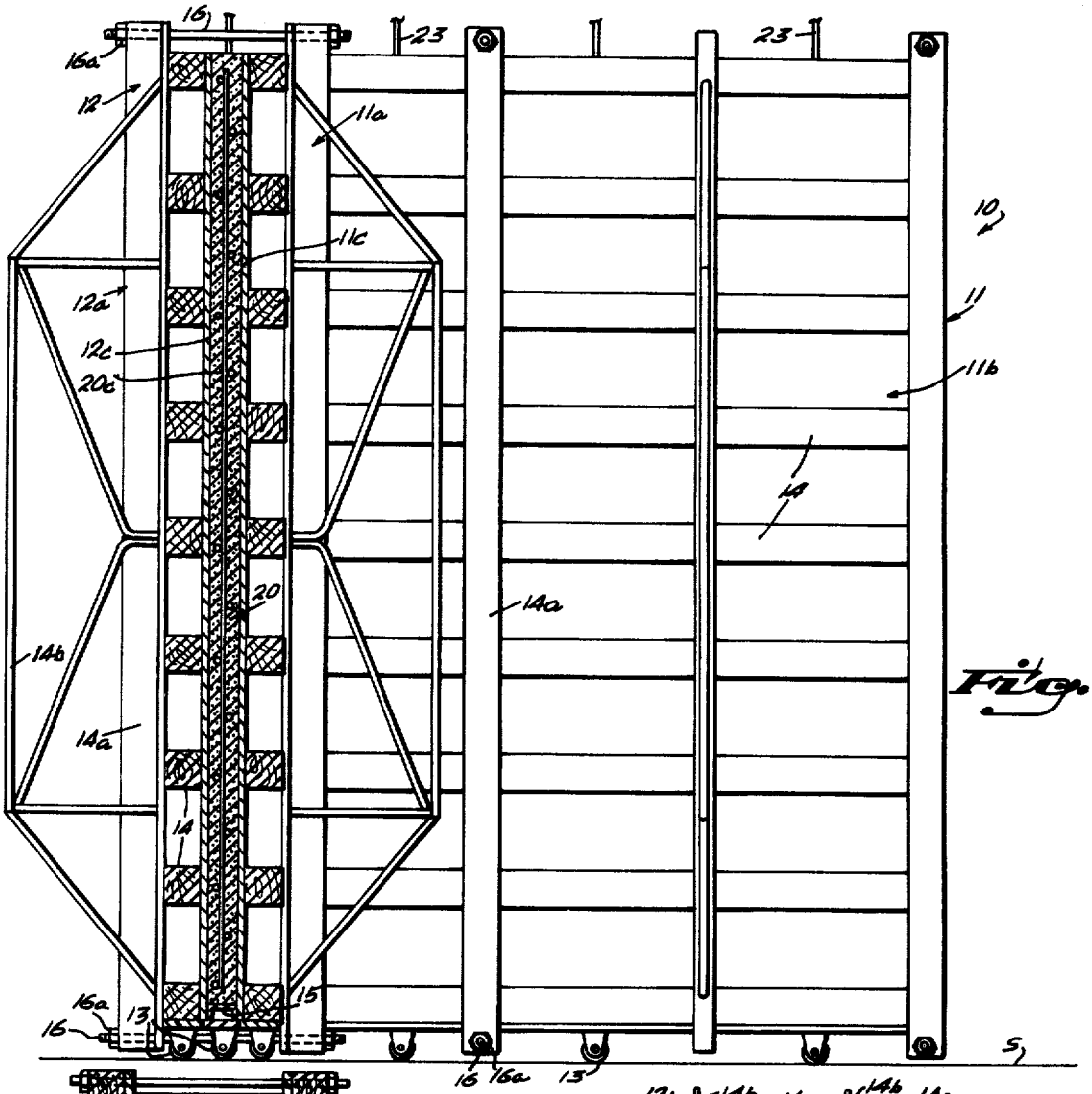
FIG. 2 is a vertical sectional view taken through one of the intersecting sections of an L-shaped mold embodying the invention for precasting an L-shaped wall unit similar to those shown in FIG. 1, the mold being in closed position and filled with poured concrete.
Figure 2A:
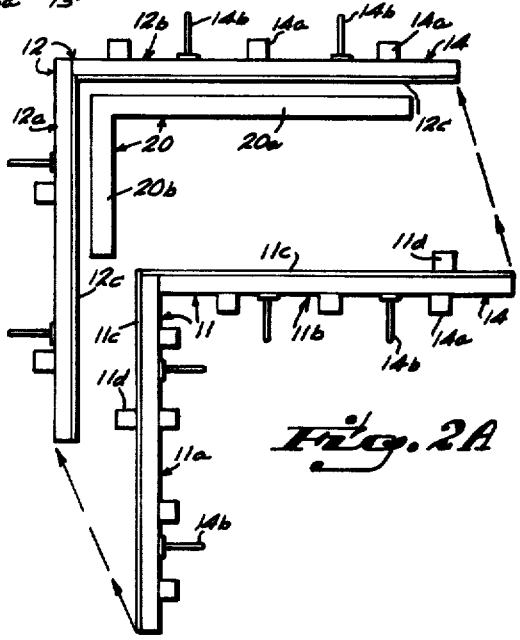
FIG. 2A is a diagrammatical plan view of the mold shown in FIG. 2 illustrated in open position preparatory to wheeling the partially cured concrete L-shaped unit from between the separated vertical mold sections.

Referring in detail to the drawings, 10 denotes a vertical L-shaped molding apparatus for precasting wall units 20, each having two wall sections **20*a* and 20*b* integrally formed in right angular, L-shaped, relation. Molding apparatus 10 is shown in FIGS. 2 and 2A to have inner and outer separable, vertical sidewall forms 11 and 12, each comprising a pair of wall sections 11*a*, 11*b* and 12*a*, 12*b*, respectively, disposed in right angular relation and having plywood mold surfaces 11*c* and 12*c* supported by a suitable framework in an upstanding position on a plurality of spaced wheels 13, which may be mounted as castors for omnidirectional and independent transport of the forms 11 and 12 on a horizontal surface S. The supporting framework for each of the wall sections 11*a*, 11*b* and 12*a* and 12*b*, as seen in the drawing, may include horizontally extending and vertically spaced beams or timbers 14, vertically extending and horizontally spaced beams or timbers 14*a* and one or more vertically extending trusses 14*b*. Additional structure (not shown), including timbers 14, 14*a* and trusses 14*b* spaced closer together along each wall section, may be provided for the framework as required by the weight of the concrete unit 20 to be poured and bracing means (not shown) may also be used for retaining each pair of wall sections 11*a*, 11*b* and 12*a*, 12*b*** in proper right angular relation.

The bottom 15 of molding apparatus 10 has an L-shaped configuration and is also mounted on wheels 13 for omnidirectional transport on surface S independently of sidewall forms 11 and 12. As seen in FIG. 2, mold bottom 15 may be formed as a pair of U-shaped steel channels arranged at right angles and mounted in an inverted position on wheels 13 to provide a flat surface for the bottom wall of the mold. A plurality of threaded rods 16, terminating at opposite ends in nuts **16*a*, serve to releasably secure the wheeled bottom wall 15 between the wheeled sidewall forms 11 and 12 as a closed operative mold. To avoid passing through the concrete structure, rods 16 may be located to extend through the space below the U-shaped channels provided by wheels 13 and above the level of the concrete when poured and may engage sidewall forms 11 and 12 by extending through opposite ends of the vertical timbers 14*a***.

End walls for the mold may be provided by any suitable means, which, in FIG. 2A, are indicated as vertical timbers **11*d* carried on the mold face of wall sections 11*a* and 11*b*. In practice, end closure timbers 11*d*, or the like, may be separate and removable from engagement between sidewall forms 11 and 12 prior to opening the mold. Readily removable clamps (not shown, but conventional in the art) may be located beyond end closure timbers 11*d* or any other end wall structure to secure sidewall forms 11 and 12** together in closed position.

Figure 1:
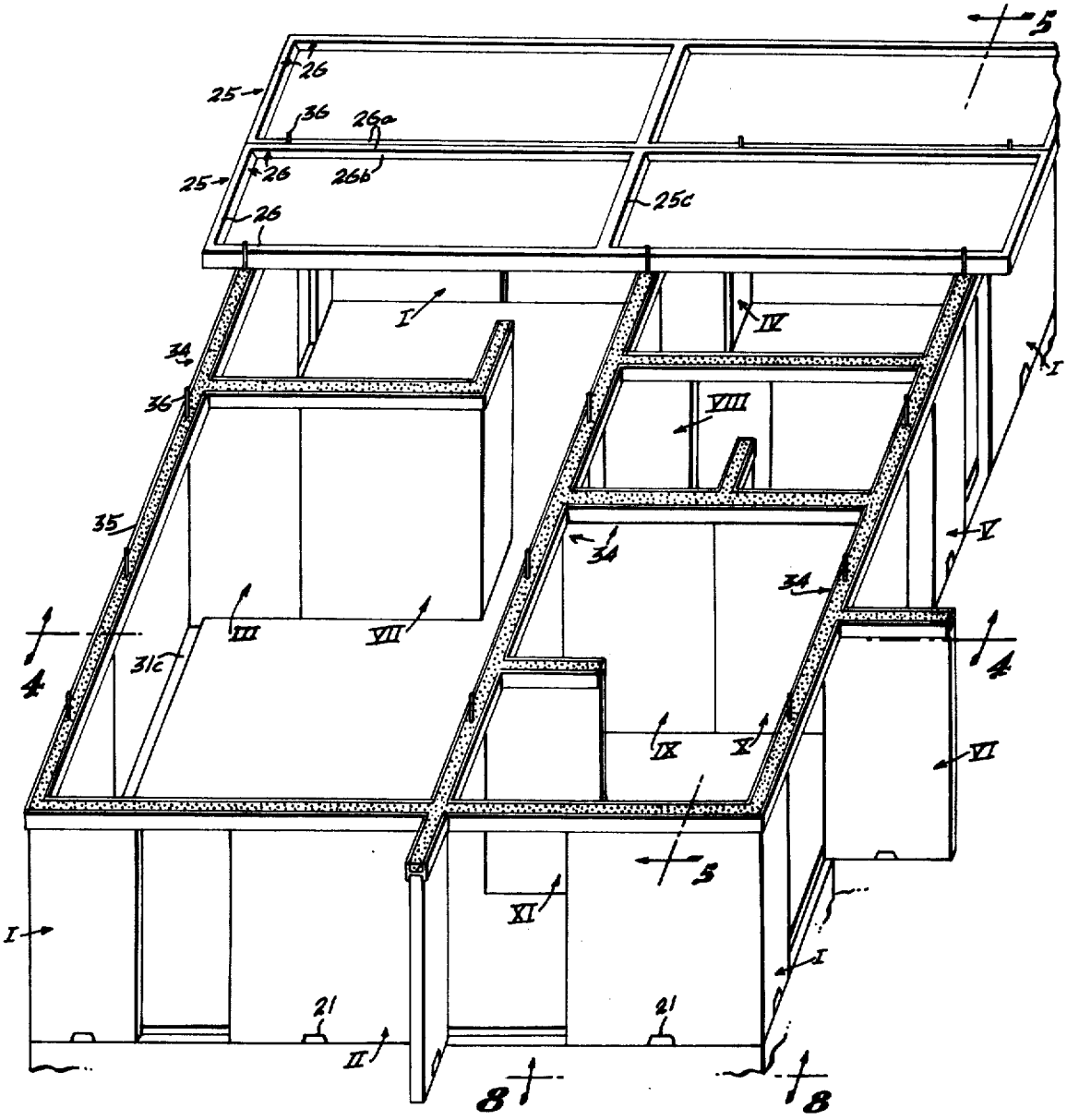
FIG. 1 is a perspective view of a one story building embodying the invention showing L-shaped wall units positioned on the foundation and having interconnecting H-beams extending across the tops thereof preparatory to completing the roof, two roof slabs being shown in place on the H-beams.
Figure 3:
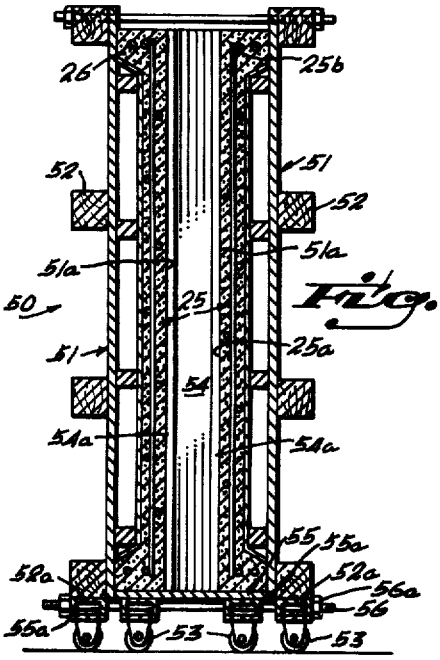
FIG. 3 is a vertical sectional view of a mold for the roof slabs shown in closed position and filled with poured concrete.
Figure 6:
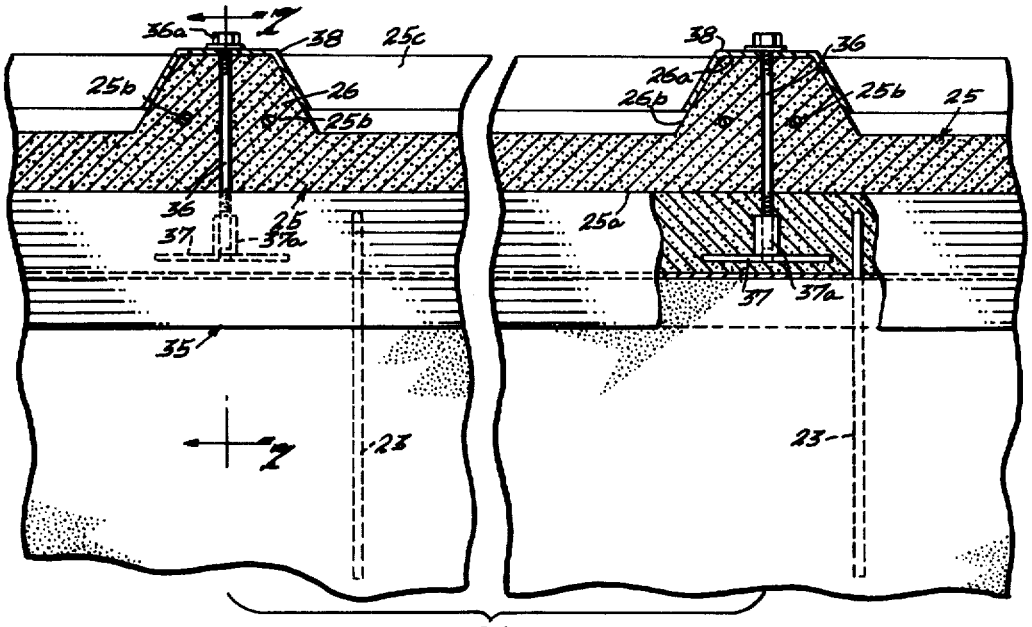
FIG. 6 is an enlarged fragmentary sectional view of the roof and top portion of the wall taken on a line similar to FIG. 5, parts being broken away to show details of the H-beam and the attachment of the roof slabs to the wall units.
Figure 7:
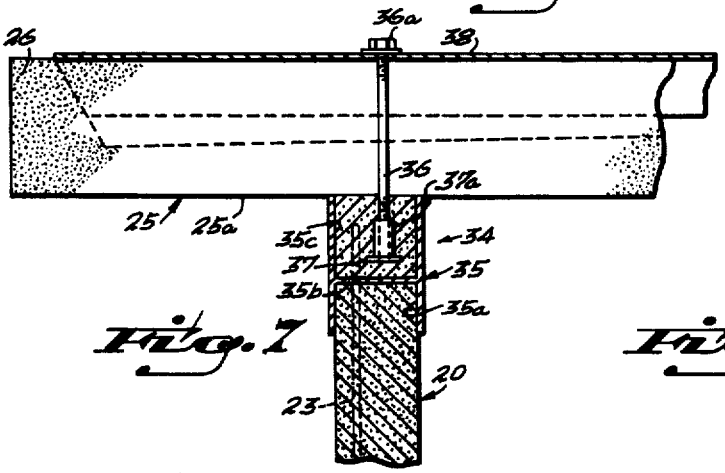
FIG. 7 is a sectional view taken on line 7—7 in FIG. 6.

A modified form of apparatus 10 is shown in FIG. 3 as molding apparatus 50 for precasting substantially flat and elongated concrete roof slabs 25, each having, as seen in FIGS. 1, 6 and 7, a flat bottom side **25*a* and an upfacing side formed with a thickened peripheral border 26 and an intermediate transverse rib 25*c*. Roof slabs 25 may be cast in pairs, each standing on a longitudinal side with the plane of the bottom side 25*a*** disposed vertically and facing each other in back-to-back relation.

Molding apparatus 50 comprises a pair of vertical sidewall forms 51, having plywood mold surfaces **51*a* which are suitably contoured to mold peripheral border 26 and transverse rib 25*c* in the upfacing side of each slab 25, and a mold bottom plate 55 which supports a vertically extending spacer 54 having opposite plywood mold surfaces 54*a* to mold the flat bottom side 25*a* of each of the back-to-back roof slabs 25. Plywood mold surfaces 51*a* are each suitably supported by a framework 52 which is mounted on a plurality of spaced wheels 53 for independent and separate transport of forms 51 on horizontal surface S. The bottom plate 55 is supported on a pair of longitudinally extending parallel spaced channels 55***a*, one beneath each mold cavity provided between mold surfaces 51*a* and 54*a* and mounted on a plurality of spaced wheels 53 for transport of bottom plate 55 on surface S independently of sidewall forms 51. A plurality of spaced threaded rods 56, each terminating at opposite ends in nuts 56*a*, serve to releasably retain wheeled bottom plate 55 between wheeled sidewall forms 51 as a closed operative mold, and, in the same manner as rods 16 in apparatus 10, may be located above and below the poured concrete. Removable end walls (not shown) are suitably mounted at opposite ends between sidewall forms 51 to complete the double cavities for molding roof slabs 25. A bracing means (not shown) may also be mounted on wheels and project in angular relation from the framework 52 as part of each sidewall form 51 to add stability to and retain the latter in vertical upright position when wheeled apart to an open mold position.

Figure 9:
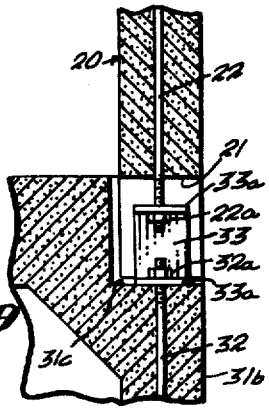
FIG. 9 is a sectional view taken on line 9—9 in FIG. 8.
Figure 8:
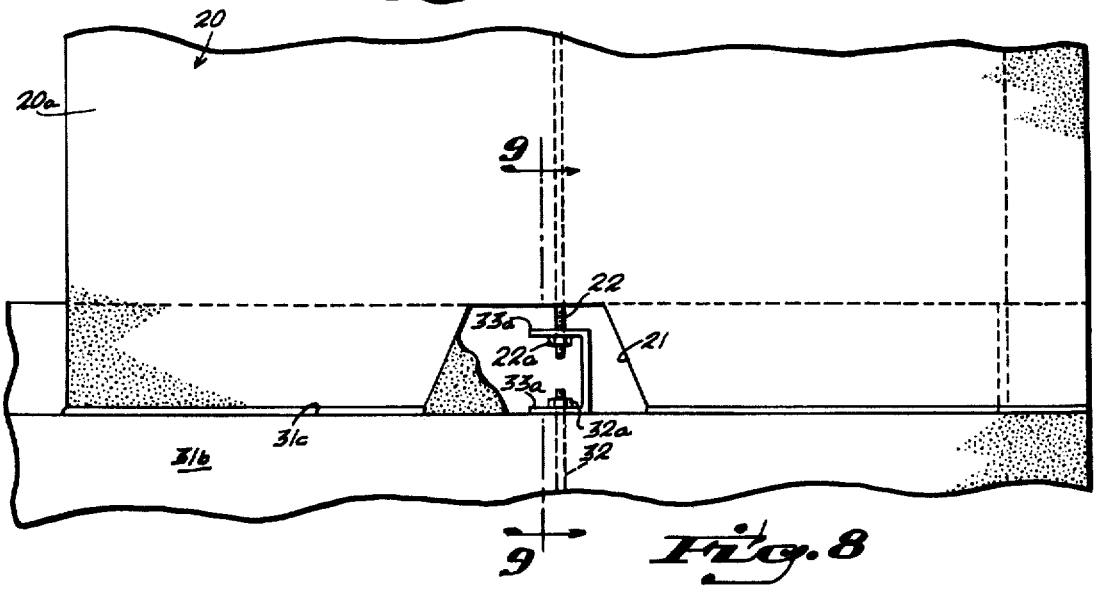
FIG. 8 is an enlarged fragmentary elevational view as seen along line 8—8 in FIG. 1 showing details of the means for anchoring the L-shaped wall units to the foundation.

The operation of apparatus 10 and 50 in the manufacture of precast concrete wall units 20 and roof slabs 25, respectively, involves the method embodiment of the invention as will now be apparent. Molding apparatus 10 is assembled as shown in FIG. 2 and preparatory to pouring a concrete mix of any conventional formulation, but without any setting time accelerators to increase the cost thereof, a latticework of reinforcing rods 20*c* and various tie rods, as hereinafter more fully described, and conventional lifting rings or hooks (not shown) are properly positioned within the mold cavity. Also, suitably shaped and dimensioned wood blocks (not shown) may be positioned on bottom 15 to provide the cutouts 21 from the bottom edges of wall sections 20*a* and 20*b* as seen in FIGS. 8 and 9. After pouring the mixed concrete through the open top of the mold cavity and, with the aid of vibrators (not shown), filling the mold to the proper level to form wall unit 20, all of which is performed in the manner and by equipment well known in the art, molded wall unit 20 is permitted to remain in the closed mold until capable of freestanding without the aid of mold sidewalls 11 and 12. This capability requires a time interval of 2½ to 3 hours, after which time rods 16 are removed, enabling sidewall forms 11 and 12 to be separated from bottom 15 and rolled apart on wheels 13 to a relative position as indicated in FIG. 2A. Bottom 15, carrying partially cured wall unit 20, may now be rolled on its wheels 13 to a location on horizontal surface S completely clear of the separated sidewall forms 11 and 12. A replacement bottom 15 is then rolled into position and assembled with sidewall forms 11 and 12 to ready the mold cavity for immediate installation of the reinforcing rod latticework and the tie rods and the pouring of concrete for the next wall unit 20. Several concrete pourings, utilizing the same sidewall forms 11 and 12 with different bottoms 15, are performed and partial curings achieved while each wall unit 20 remains in its freestanding position on its wheeled bottom 15 completing its curing process requiring upwards of 10 additional hours until completely set and ready for vertical lifting by conventional crane equipment from bottom 15 and transporting to a location on the building foundation to serve in the manner hereinafter described as a vertical structural wall element.

Molding apparatus 50 is assembled as shown in FIG. 3 with spacer 54 mounted on bottom plate 55 and preparatory to pouring the concrete mix, latticework or reinforcing rods 25*b*, and if required, lifting rings or hooks (not shown), are properly positioned within the back-to-back mold cavities, the method whereby roof slabs 25 are precast in apparatus 50 being similar to that hereinbefore described for wass unit 20. Thus, after an elapse of 2½ to 3 hours for partial curing of roof slabs 25, rods 56 are removed and sidewall forms 51 are rolled apart on wheels 53 permitting bottom 55, bearing the two partially cured roof slabs 25 in back-to-back relation, to be wheeled clear of sidewall forms 51 for final curing while the latter are reused with another bottom 55.

Figure 4:
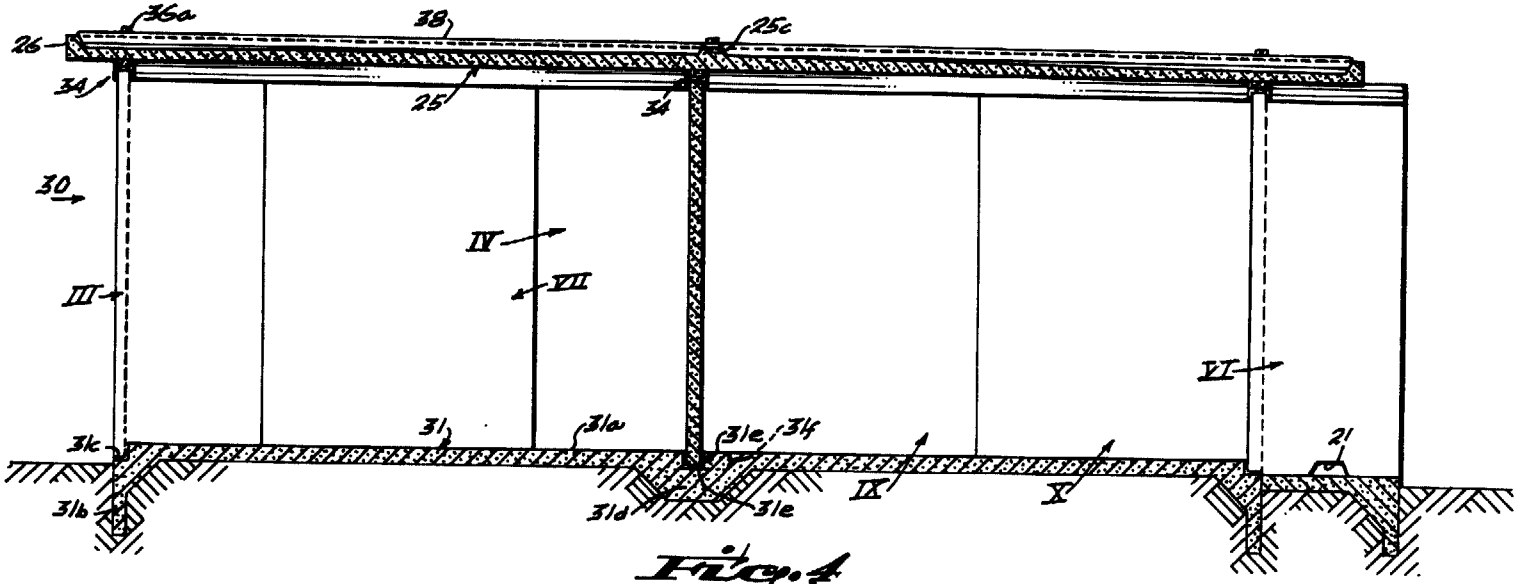
FIGS. 4 and 5 are vertical sectional views taken on lines 4—4 and 5—5, respectively, in FIG. 1, but with all roof slabs in position.
Figure 5:
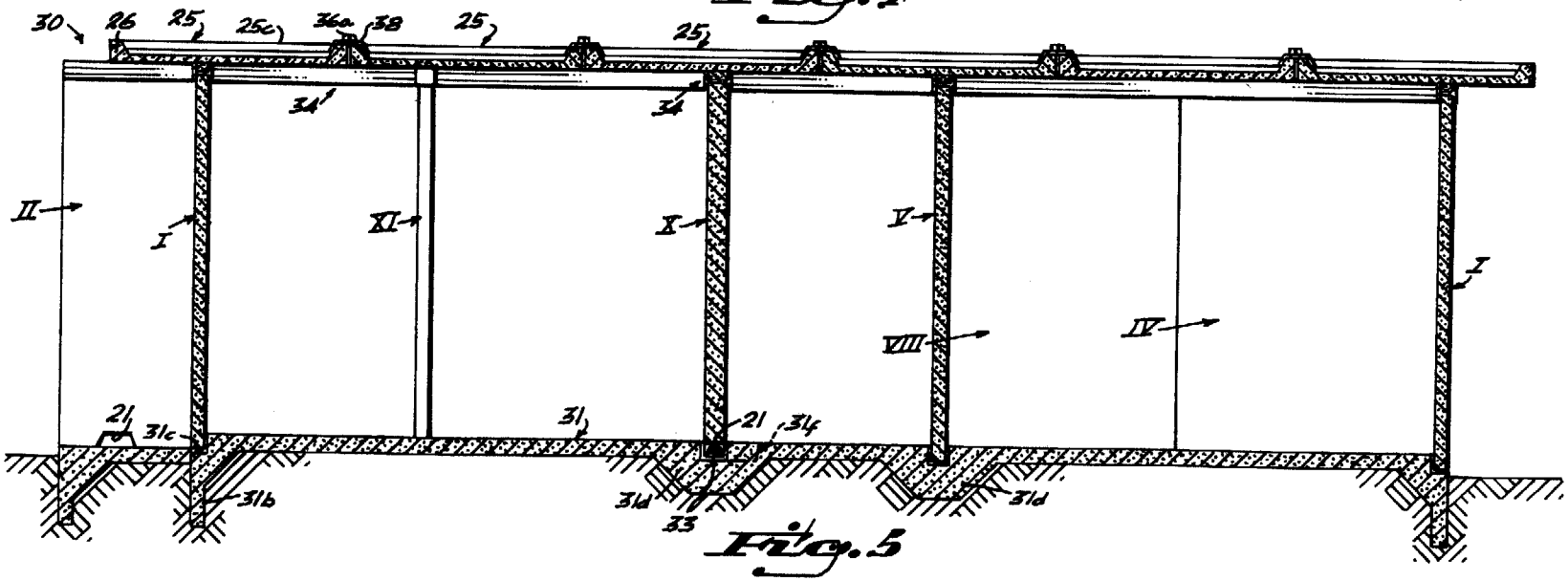

Building 30 is shown in FIGS. 1, 4 and 5 to be constructed on a reinforced concrete, ground level foundation slab 31 having a flat upfacing surface 31*a* providing the floor of the building and having downwardly extending sidewalls providing a peripheral footing 31*b* for the exterior walls of the building. Various thickened portions of slab 31 in a predetermined arrangement provide footings 31*d* for the interior walls of the building or for outwardly projecting exterior wall sections. The upfacing surface of footing 31*b* has a peripheral ledge 31*c* and footings 31*d* have depressed seats 31*e*, the latter and ledge 31*c* being stepped down from floor surface 31*a* a uniform predetermined distance. Seats 31*e* have widened areas 31*f* at predetermined locations in the manner and for the purpose hereinafter more fully described.

All the structural walls of building 30 comprise precast L-shaped wall units 20 or a left orientated version thereof. Thus, wall units 20 are positioned on peripheral ledges 31*c* at the four corner locations I of foundation slab 31 and at intermediate locations II, III, IV, V and VI where one wall section of each of the units 20 is positioned on peripheral ledge 31*c* and spaced between corner locations I. The other wall sections are positioned on seats 31*e* of footings 31*d* which intersect at right angles with peripheral ledge 31*c*. Those wall units 20 serving solely as interior wall structure are positioned on L-shaped seats 31*e* of footings 31*d* and are seen at locations VII, VIII, IX, X and XI. Locations IX and X are left orientated Ls, that is, the short section 20*b* extends toward the left rather than towards the right of long section 20*a*.

To anchor each of the L-shaped wall units 20 in its location on foundation slab 31, a cutout 21 is precast in a midportion of each wall section 20*a* and 20*b* to extend as a recess from the bottom edge thereof. A tie rod 22 having a threaded end is precast and embedded in each wall section 20*a* and 20*b* and extends vertically downwardly into a midportion of each cutout 21. Likewise, footings 31*b* and 31*b* have tie rods 32 suitably embedded therein with threaded ends extending vertically upwardly above ledge 31*c* and seats 31*e* to vertically align in spaced relation with each tie rod 22 when the respective wall unit 20 is vertically lowered into its predetermined position. The gap separating the respective ends of each tie rod 22 from 32 is bridged by an interconnecting U-shaped bracket 33 having opposite parallel sides 33*a* horizontally disposed, each formed with an opening through which the threaded ends of tie rods 22 and 32 project and mount nuts 22*a* and 32*a*, respectively, which are tightened against the inner surface of bracket 33.

Cutouts 21, which may have a height equivalent to the depth of ledges 31*c* and seats 31*e* from upfacing surface 31*a*, are readily accessible from the exterior sides of foundation 31 for mounting brackets 33 and tightening nuts 22*a* and 32*a*. Seats 31*e* which would ordinarily obscure cutouts 21 have widened areas 31*f* in foundation 31 located to register with the cutouts 21 and provide working accessibility thereto. After the brackets 33 are secured and nuts 22*a* and 32*a* are tightened, areas 31*f* and cutouts 21 are filled with concrete, finishing the floor and wall structure.

A feature of the invention which materially contributes to the saving of time and labor in the construction of building 30 is the use of a composite beam 34 to extend across the tops of each group of wall sections 20*a* and/or 20*b* positioned in a common vertical plane. For example, a composite beam 34 extends the length of each of the four exterior walls of building 30 and bridges the open spaces between the wall sections of each corner wall unit 20 and the one or more intermediate wall section as lintels to which the tops of door and window frames (not shown) are mounted. Composite beams 34 serve in a similar manner with respect to interior wall structure where the spaces between coplanar wall sections may mount door frames or partition walls (not shown).

With the L-shaped units 20 in position, an H-beam 35 made of a suitable metal, such as extruded aluminum, is placed across the tops of each coplanar group of wall sections so that the top edges of sections 20*a* and/or 20*b* extend into the downfacing channel 35*a* and supportingly engage the horizontal cross-piece 35*b*. Where required, the side wall of the H-beam forming channel 35*a* may be cut out to accommodate the intersecting companion right angularly extending wall section and insure a level fit. Preparatory to mounting a composite beam 34, each of the wall sections 20*a* and 20*b* of units 20 has been precast with one or more embedded vertical tie rods 23 at predetermined locations having ends projecting above the top edges thereof a distance to terminate short of the top edges of H-beam 35 when mounted thereon as seen in FIGS. 6 and 7. Horizontal cross-piece 35*b* has openings cut therein through which tie rods 23 extend into the upfacing channel 35*c*.

With H-beams 35 in position and prior to pouring the concrete into upfacing channel 35*c*, suitable reinforcing rods (not shown) and vertically extending threaded tie rods 36, which have their lower ends threaded into collars 37*a* of winged anchor fittings 37, are installed in channels 35*c*. Tie rods 36 are placed in predetermined positions to extend between adjacent roof slabs 25, the latter being installed to rest upon composite beams 34 after the poured concrete filling channels 35*c* sets, embedding tie rods 23 and 36 therein and completing composite beam 34. As will be clear from FIG. 1, at intersections of H-beams 35 appropriate portions of sidewall forming upfacing channel 35*c* may be cut out to provide an uninterrupted channel for receiving the poured concrete therein which will unite all composite beams 34 by an integral concrete structure.

As seen in FIGS. 1, 4 and 5, the dimensions of precast roof slabs 25 are of a length sufficient to extend the width of building 30 and overhang the opposite exterior walls as eaves. Likewise, roof slabs 25 are of a width permitting a plurality of uniform sized slabs to cover building 30 in longitudinal side-by-side relation and have the endmost slabs overhang the front and rear exterior walls as eaves similar to those overhanging the exterior side walls.

Tie rods 36 are arranged in parallel rows of three spaced to accommodate a roof slab 25 therebetween and are located in those composite beams 34 which are seen in FIG. 1 to extend along the exterior opposite side walls of building 30 providing end anchoring means for adjacent roof slabs 25. Midportion anchoring means are provided by the location of tie rods 36 in beams 34, seen to extend along interior walls which also serve to support the midportion of roof slabs 25. After being lifted into position by well known crane equipment so that flat bottom sides 25*a* rest on composite beams 34 and the thickened peripheral borders 26 of the longitudinal sides align against the rows of tie rods 36 extending vertically between adjacent roof slabs 25, a tie-down joint is effected by suitable means, such as metal elongated strips 38, each seen in FIGS. 4, 5, 6 and 7 as being channel shaped and having a cross-section which conforms to the width of the upper flat surfaces 26*a* and the downwardly extending interior sides 26*b* of adjacent thickened peripheral borders 26. Strips 38 have registering openings through which the ends of tie rods 36 extend for receiving nuts 36*a* which secure strips 38 in engagement with thickened peripheral borders 26, midportions of each strip 38 being cutout to accommodate transverse ribs 25*c*. Suitable roofing material, such as roofing paper, tar and gravel (not shown), is applied to cover roof slabs 25, strips 38 and nuts 36*a* providing a weather proof roof for building 30.

Suitable washers (not shown) may be used on the threaded ends of rods 22, 32 and 36 to underlie and reinforce nuts 22*a*, 32*a* and 36*a* in building 30 as well as on rods 16 and 56 under nuts 16*a* and 56*a* in apparatus 10 and 50, respectively.

The method and use of wheeled sidewall forms 11 and 12 are well adapted to precast units of L-shape or other configuration in a variety of thicknesses including units having sections of different thicknesses by providing bottoms 15 of comparable width. Also, the length of the respective sections of the unit may be varied by providing bottoms 15 of comparable length or by placement of end walls 11*d* to shorten the effective length of an existing section of bottom 15.

The precast concrete molding apparatus and method and the building construction utilizing precast L-shaped structural units and roof slabs are seen to achieve the several objects of the invention and to be well adapted to meet conditions of practical use. As various possible embodiments might be made in this invention, and as various changes might be made in the disclosed apparatus, method and building construction, it is to be understood that all matter herein set forth and shown in the accompanying drawings are to be interpreted as illustrative and not in a limiting sense.

What is claimed is:

1. In a method for molding precast concrete building units, the steps of pouring the concrete into a mold cavity formed by a pair of opposite vertical walls and a supporting bottom, all separable from each other and mounted on wheels for transport on a horizontal supporting surface to effect said separation, maintaining the poured concrete in the assembled mold for a period of 2½ to 3 hours for partial curing of said unit, disassembling the mold cavity by separating the vertical walls from the supporting bottom by wheeling on said horizontal surface leaving the partially cured unit solely supported on said bottom, wheeling the bottom with the unit along said horizontal surface to clear the separated vertical walls, and maintaining the unit on said bottom until completely cured for vertical lifting therefrom while assembling the vertical walls with another supporting bottom into a mold cavity by wheeling the vertical walls and bottom into position on said horizontal surface and repeating the molding cycle therewith.

2. An apparatus for molding a precast concrete building unit, a mold cavity for molding said unit in a vertically disposed position comprising a mold bottom supported on wheels for transport on a horizontal surface and being sized and shaped to support the molded unit free-standing in said vertical position, opposite sidewall mold members, each free-standingly mounted on wheels for transport on said horizontal surface to separate from each other and from said mold bottom from a closed position in operative engagement with said mold bottom to an open position spaced a sufficient distance from each other enabling said mold bottom while carrying a partially cured concrete unit to be wheeled horizontally on said surface completely free of said sidewall mold members to complete the curing of the unit, and at least one other wheeled mold bottom for wheeling horizontally on said surface to an operative position between said sidewall mold members for immediate reuse of the mold.

3. The apparatus defined in claim 2 in which said mold bottom comprises an inverted U-shaped channel supported on said wheel, and tie rods spaced along said bottom releasably securing said mold bottom between said wheeled sidewall mold members located to extend through a space below said U-shaped channel between said wheels and engaging said opposite sidewall mold members to avoid passing through the cast concrete within the mold cavity.

4. The apparatus defined in claim 2 in which said mold bottom and opposite sidewall mold members are L-shaped with one member having an inner surface facing the mold bottom and the other member having an outer surface facing the mold bottom, said L-shape providing the molded unit with said freestanding characteristic.

5. The apparatus defined in claim 2 in which said mold bottom and opposite sidewall mold members are constructed and arranged to mold a pair of rectangular slabs as said molded unit, each slab having a flat bottom surface and a thickened peripheral border, said mold bottom providing support for a longitudinal side of each of said slabs and supporting a vertically extending spacer along a midportion thereof against which each of said slabs is molded in back-to-back relation, said mold bottom including a flat plate mounted on a pair of parallel spaced channels, one located beneath each slab.

* * * * *